United States Patent [19]

Hirneise

[11] Patent Number: 4,561,189

[45] Date of Patent: Dec. 31, 1985

[54] CHALKING LINE HOLDER

[76] Inventor: Paul J. Hirneise, 2203 SW. 72nd Ter., Gainesville, Fla. 32608

[21] Appl. No.: 730,821

[22] Filed: May 6, 1985

[51] Int. Cl.[4] ..... B44D 3/00

[52] U.S. Cl. ..... 33/408; 33/413

[58] Field of Search ..... 33/408, 409, 410, 413, 33/414, 339, 1 LE

[56] References Cited

U.S. PATENT DOCUMENTS

| | | | |
|---|---|---|---|
| 472,593 | 4/1892 | Tache . | |
| 527,335 | 10/1894 | Katani . | |
| 909,846 | 1/1909 | Cavileer . | |
| 1,017,390 | 2/1912 | Dittrich . | |
| 1,064,087 | 6/1913 | Prescott . | |
| 1,098,033 | 5/1914 | Friendship . | |
| 1,106,152 | 8/1914 | McIntosh . | |
| 2,663,938 | 12/1953 | Stodgell . | |
| 3,122,836 | 3/1964 | Aciego . | |
| 3,183,595 | 5/1965 | Jopperi | 33/408 |

*Primary Examiner*—Harry N. Haroian

*Attorney, Agent, or Firm*—Charles A. Bevelacqua

[57] ABSTRACT

A holder or assister for enabling one person to set and stretch a chalking line and strike a chalk line without an assistant. The holder comprises a toe plate, a tubular member and a retainer plate integrally formed with each other and a center shaft inside the tubular member, these parts cooperate to hold the assister on various configurations of workpieces. Means are provided to attach one end of a chalking string to the assister and to permit accurate alignment of the chalking string with a reference mark on which a chalk line is to be struck.

12 Claims, 7 Drawing Figures

Figure 1.
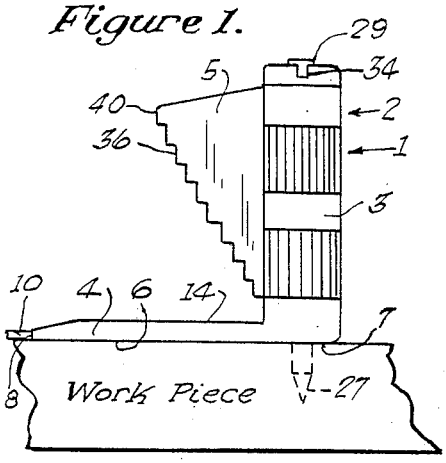
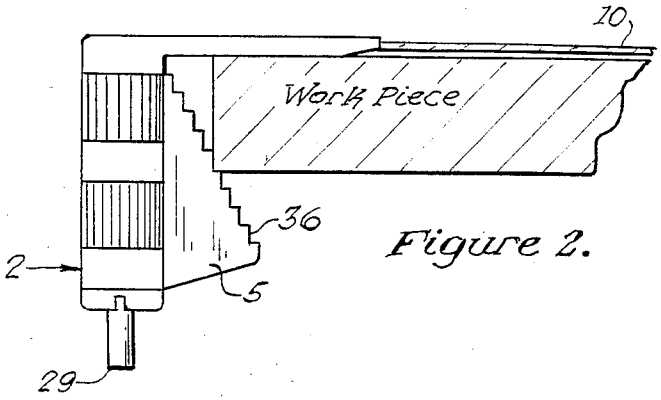
Figure 2.
Figure 3.
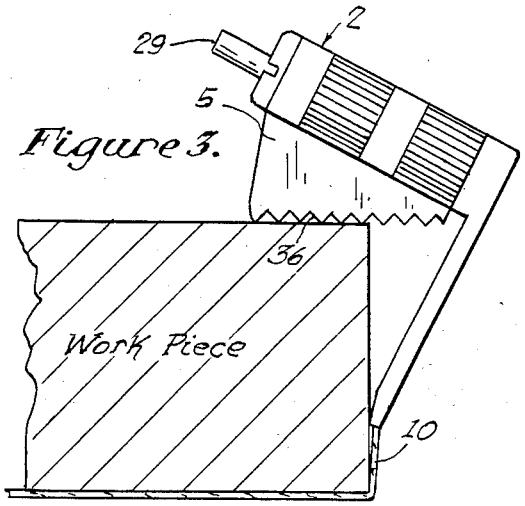
Figure 4.
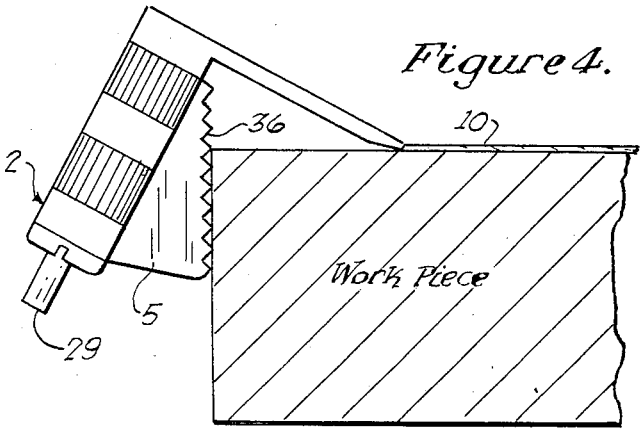
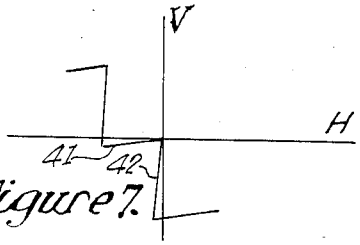
Figure 7.
Figure 5.
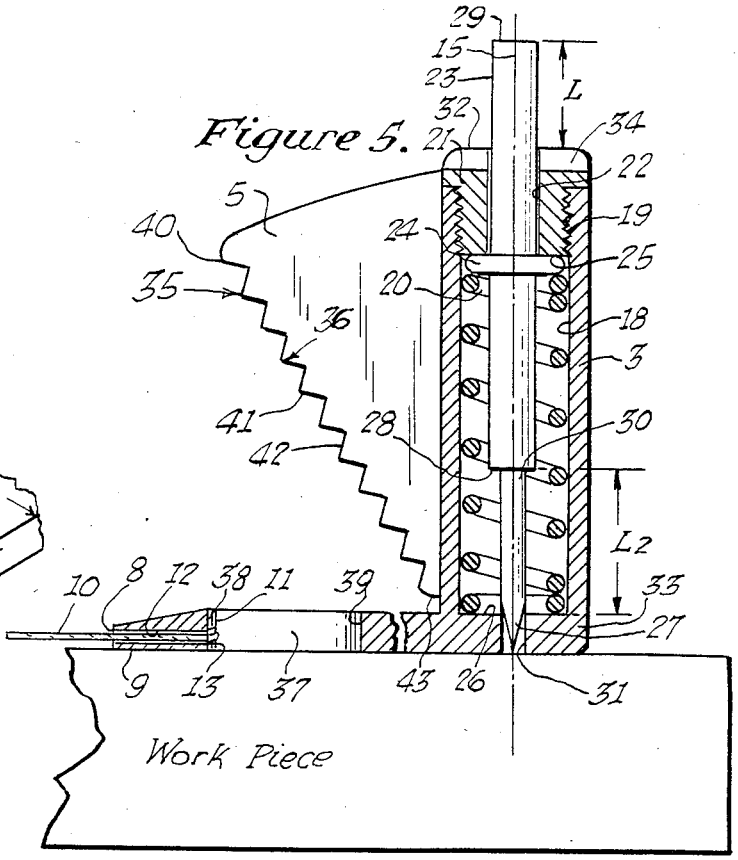
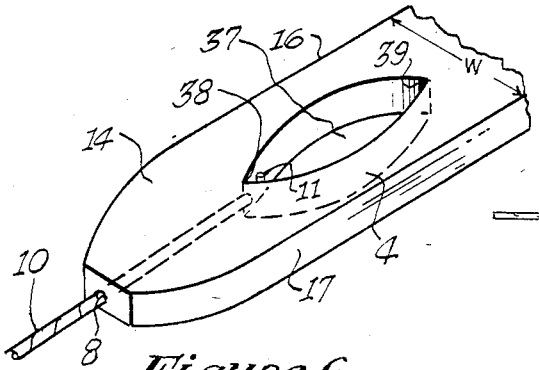
Figure 6.

CHALKING LINE HOLDER

BACKGROUND OF THE INVENTION

This invention relates to device for applying a chalk line as used in construction and carpentry work, more particularly, it is concerned with a line or string holding device for facilitating the application of a chalk line of relatively long length, by one workman without an assistant. To avoid confusion, the mark applied to the work will be referred to as a "chalk line" and the line or string which is coated with chalk and then snapped to mark a line on the workpiece will be called a "chalking line" or "chalking string". In conventional practice, to apply a long chalk line to a surface, two workmen hold opposite ends of a chalking string or line which is coated with chalk. With the line held taught, one of the workmen pulls his end of the string away from the surface and allows it to snap back. This action produces a line of chalk which can be used as a base line or reference point for further work. When a line is to be marked on a straight flush surface, one end of the string may be held by a heavy object if the surface is horizontal or a nail or other pointed instrument may be driven into the workpiece and used to hold one end of the line. While some of these methods may be workable, they are cumbersome and makeshift at best. They will not work where it is undesirable to mark or damage the surface.

SUMMARY OF THE INVENTION

The invention relates to a line holding device which can be used by a single operator in substantially all situations where a chalk line is desired to be struck. The chalking line holder or retainer is small and relatively simple in construction. It is made so that it can be readily carried in the pocket or apron of a worker. It has a point which is retractable to avoid damage to clothing or injury to the person carrying it. It is made so that it can be applied to almost any surface on which a chalk line is desired to be struck. It is constructed so that the chalking line is retained in a position closely adjacent to the surface to produce a chalk line which is thin and solid along its entire length. The chalking line holder is used on some surfaces by driving a small pin which secures it. The holder is constructed so that penetration of the pin is limited and to facilitate removal of the retainer with a claw hammer or other prying device.

Accordingly, it is an object of the present invention to provide a chalking line holder which may be used to secure one end of chalking line to almost any configuration of surface.

Another object of the invention is to provide a chalking line holder which is relatively simple in construction but is durable and effective to perform the function for which it is intended.

Another object of this invention is to provide a chalking line holder so constructed that it will help to maintain the chalking line in a position relatively close to the surface to be chalked to improve the accuracy and kisibility of the chalk line.

Still another object of the invention is to provide a chalking line holder which can be readily removed from the workpiece to which it has been attached.

These and other objects, features and advantages of this invention, will become apparent from the following description in conjunction with the accompanying drawings.

BRIEF DESCRIPTION OF THE DRAWINGS

FIG. 1 is a side view of the chalking line holder being used on a large flat surface with the securing pin driven into the workpiece.

FIG. 2 is a side view of the chalking line holder held in place by its notched retainer plate.

FIG. 3 is a side view of the holder applied to a thick workpiece whose back surface is accessible.

FIG. 4 shows the chalking line holder applied to a thick workpiece whose back surface is not accessible.

FIG. 5 is a cross sectional view of the chalking line holder showing the securing pin fully retracted.

FIG. 6 is a fragmentary view of the front of the toe plate of the holder showing certain details of its construction.

FIG. 7 is a fragmentary view showing preferred construction of the serrations 36.

DESCRIPTION OF THE PREFERRED EMBODIMENT

Referring to the drawings, the holder or assister 1 comprises a main body member 2 comprising a tubular member 3, toe plate 4 and a notched plate 5. The bottom surface 6 of the toe plate is a continuation of the bottom surface 7 of the tubular member 3. The toe plate has a through opening 37 of generally elliptical shape with converging ends 38 and 39. Toe plate 4 has a width w somewhat greater than the outside diameter of the tubular member and has a string outlet 8 at its free end 9. A bore 12 forms a connecting passageway from the string outlet 8 to the end 38 of opening 37. An inner outlet 13 is provided where the bore 12 enters the opening 37. A portion of the surface of the workpiece can be viewed through the opening 37.

The ends 38 and 39 are accurately aligned with the bore 12 so that the retainer and consequently the chalking line can be accurately positioned with respect to a mark on the work surface with which the chalk line is to be aligned. The chalking string 10 can be fed through the outlet 8, through the connecting passageway 12 and back out through inner outlet 13. A retainer such as a knot, clip or other device 11, keeps the string from being pulled out of the toeplate when it is pulled tight. As seen in the drawings, the notched plate 5 is formed integrally with or securely attached to the tubular member 3 in a radial plane passing through the center or axis 15 of member 3 and perpendicular with and centered midway between the edges 16 and 17 of toe plate 4.

Referring now to FIG. 5, it will be seen that the tubular member 3 has an internal bore 18 extending substantially along the length of the tubular member. Bore 18 has a bottom 26 and a threaded portion 19 near its upper end. The bore 18 is closed at its upper end by a cap 21 externally threaded to match the threads of the bore 18 and having an internal bore 22 which accepts a center shaft or pin 23 which is of generally cylindrical configuration. The size of the bore 22 is such that the center shaft can slide relatively freely therein. The center shaft 23 is provided with an annular ring 24 which abuts the bottom 25 of the cap 21 and also serves as an abutment for spiral compression spring 20 which is housed within the bore 18 between the annular ring and the bottom 26 of the bore. Spring 20 provides a relatively light force urging the center shaft 23 to its fully retracted position with annular ring 24 abutting the bottom 25 of cap 21. When the pointed end 27 of the center shaft is driven into a wood or other surface, the force of the spring 20 is insufficient to interfere with its being driven or to dislodge it. The center shaft 23 terminates in a securing or drive pin 30 of reduced diameter thereby providing an annular shoulder 28. Drive pin 30 terminates in a point 27 which can be driven into a work surface. The top of the center shaft has a striking surface 29 which can be struck with a hammer to drive it into the end of the workpiece. The base 33 of the cylindrical member has a central bore 31 of a diameter to permit easy passage of the pointed end 27 and the drive pin 30. The annular shoulder 28 limits relative movement between the center shaft and the body member in a longitudinal direction. When the center shaft is driven by a hammer it can only be driven until the top of the striking surface is substantially flush with the top surface 32 of the cap 21. The distance that the center shaft can thus be driven is indicated by the letter "L" in FIG. 5. This distance is appreciably shorter than the distance L2 between the annular shoulder 28 and the bottom 26 of the bore 18 so that a space will remain between the annular shoulder 28 and the bottom of the bore when the center shaft has been driven as far as it can be driven into the work piece. This allows the body member to be raised slightly against the force of spring 20 so that a hammer claw or other tool can be inserted between the work piece and the base 33 of the body member. Then when a prying force is applied to the tool the tubular member will move upward until the bottom 26 of the bore 18 engages the annular shoulder 28. Further prying and displacement of the body member in the upward direction will pull the pointed end of center shaft 23 out of the work piece releasing the the chalking line assister. When cap 21 is removed the center shaft 23 and spring 20 can be removed and replaced, prolonging the useful life of the chalking line holder. Cap 21 may be secured to body member 3 in various ways. A threaded connection is preferred so the cap may be easily removed and replaced. A screwdriver slot or kerf 34 or wrenching surfaces (not shown) may be provided on the cap 21 to permit its ready removal. The notched plate and toe plate are of sufficiently sturdy construction to prevent deformation when the tool is in use. The front edge of the notched plate is inclined outwardly from its bottom edge 43 adjacent to the toe plate to its top edge 40 and has a series of stepped notches or serrations 36 along its front edge 35 of substantially equal size. The angle between the sides 41 and 42 of the serrations may be slightly less than 90° and edges 41 and 42 may be slightly inclined respectively as shown in FIG. 7 to a horizontal line H parallel to the bottom surface 6 of the toe plate and a vertical line V parallel to the axis 15 of the tubular member 3 to more effectively hold the assister on the edge of a work piece. The free end 9 of the toeplate may be tapered inward from its sides 16, 17 and may also have its top surface 14 inclined downward as shown in FIG. 5. The thickness of the free end 9 of toe plate 4 may be made just greater than the size of bore 12 through which the chalking line passes, or if made of greater thickness, may be tapered at its end as best seen in FIG. 5.

OPERATION

To use the assister, a chalking line or string is attached to the toe plate by inserting an end of the line through the bore 12 and knotting the cord or applying some other retainer, after which the cord is pulled back through the bore so that the retainer 11 and the string are locked within the opening 37. Sighting through the opening 37, the workman places the assister along the line to be marked. Then point 27 and drive pin 30 of the center shaft are driven into the surface to maintain the holder in the desired position. It will be seen that the drive pin 30 can only be driven until the top 29 of the center pin is approximately flush with the top 32 of the cap 21. At this point, because of the difference in length between the exposed part of the center pin, distance L, and distance L2 between the shoulder 28 and the bottom 26 of the bore 18 of the tubular member, a space will remain between the bottom of the bore and the shoulder 28. When it is desired to remove the assister, the tubular member 3 may be lifted against the force of the spring 20 until the bottom of the bore contacts the shoulder 28. This permits the claws of a hammer or similar prying tool to be inserted between the base 33 of the tubular member and the surface of the work piece to pry the pin 23 out of the work piece. After the assister is firmly in position on the work surface, the chalking line can be extended and pulled tight to the desired position and snapped to produce a chalk mark as desired, all by a one workman. If it is desired to mark a sheet or board with a thickness thinner than the distance from the top 14 of toe plate 4 to the top 40 of retainer plate 5, the assister is placed as shown in FIG. 2 with one of the serrations or notches 36 engaging the bottom surface of the work piece. The chalking line can then be extended the desired length and a chalk mark snapped on the surface. If it is desired to mark a thicker work piece than can be accommodated by the method just described, the assister is placed with the notches of the retainer plate 5 against the bottom surface of the work piece with the free end of the toe plate against the end of the work piece as shown in FIG. 3. The chalking line 10 is then drawn over the edge of the work piece across the surface to be marked and a chalk mark made in the usual manner. FIG. 4 shows another manner in which a thick work piece may be marked using the assister or where a mark is to be made on the outside corner of a wall or building. In this case, the retainer is positioned with the serrations of the notched plate engaging the end of the work piece or wall and the free end of the toe plate engaging the surface to be marked.

It will be obvious to those skilled in the art, that many variations may be made in the specific embodiment here presented without departing from the scope of the present invention, as set forth herein and claimed in the appended claims.

I claim:

1. A chalking line retainer for holding one end of a chalking line on the surface to be marked with a chalk line, said retainer comprising a tubular member having a longitudinal axis, a toe plate of substantially flat configuration integral with said tubular member and including means for attaching one end of a chalking line, further means also integral with said tubular member lying substantially in a plane passing through the longitudinal axis of said tubular member and substantially perpendicular to said toe plate, said toe plate and further means cooperating with each other when the chalking line retainer is placed at the end of a work piece to hold the chalking line retainer and said one end of the chalking line in a fixed position with the chalking line in close proximity to the surface to be marked without puncturing or otherwise damaging the surface of the work piece.

2. A chalking line retainer as set forth in claim 1 wherein said further means includes a series of notches to assist in engaging the edge of a work piece to help retain the chalking line retainer in a fixed position.

3. A chalking line retainer as set forth in claim 1 wherein said toe plate has a free end remote from the tubular member, a bore in said toe plate exiting at said free end, through which bore a chalking line is threaded to attach it to the toe plate, said toe plate having a thickness at its free end only slightly greater than the diameter of the chalking line whereby the chalking line is held in close proximity to the surface to be marked when the chalking line retainer is in use.

4. A chalking line retainer for holding one end of a chalking line on the surface of a work piece to be marked with a chalk line comprising a tubular member having a longitudinal axis, a toe plate integral with said tubular member and having means for attaching one end of a chalking line, said means also being effective to help position the chalking line against a surface to be marked in alignment with the position of a line to be marked as a reference, a center shaft located within said tubular member with its longitudinal axis lying along the longitudinal axis of said tubular member and being of a length substantially greater than the length of the tubular member, further means normally urging said center shaft into a position out of engagement with the surface to be marked when the chalking line retainer is placed on the work piece with the toe plate contacting said surface, said center shaft being displacable for a limited distance along its axis to engage and penetrate the surface of the work piece whereby to hold the chalking line retainer and consequently said one end of the chalking line in a fixed position along a line to be marked as a reference on said surface.

5. A chalking line retainer as set forth in claim 4 wherein said toe plate has an opening therein contiguous with the means for attaching one end of the chalking line, said opening extending through the toe plate to permit a view of a point marked on the surface of the work piece to indicate the position of a line to be marked on said surface to thereby enable a workman to place said one end of the chalking line on the line to be marked.

6. A chalking line retainer as set forth in claim 4 further characterized by means to limit the distance that the center shaft can be displaced along its axis and thereby limit penetration of the work piece by said center shaft.

7. A chalking line retainer as set forth in claim 4 further characterized by cooperating means on said tubular member and said center shaft whereby said center shaft can be disengaged from the work piece by movement of the body member along its longitudinal axis in a direction away from the surface of said work piece.

8. A chalking line retainer as set forth in claim 6 further having cooperating means on said tubular member and said center shaft whereby said center shaft can be disengaged from the work piece by movement of said body member along its longitudinal axis in a direction away from the surface of the work piece, said main body member being relatively freely moveable for a limited distance along its longitudinal axis in a direction away from the surface of the work piece after said center shaft has been driven into the work piece to the full extent permitted by said limiting means, before the aforesaid cooperating means become effective to begin disengaging the center shaft from the work piece, this limited distance being sufficient to permit the insertion of the claws of a hammer or other prying tool between the tubular member and the work surface.

9. A chalking line retainer comrpising a main body member including a tubular member and a toe plate, said toe plate having first and second opposed surfaces and a free end, at least one of said opposed surfaces being adapted to rest against a planar surface of a work piece and one of said opposed surfaces being inclined toward the other at the free end of the toe plate to form a tip of reduced thickness, an opening through said toe plate to provide a view therethrough of a portion of the surface of a work piece beneath the toe plate, string retaining means in said toe plate constructed and arranged to hold one end of a chalking string with the string extending out of the reduced tip of the toe plate, first means to hold said retainer in a fixed position on a work piece with the first of said opposed surfaces adjacent a surface of said work piece on which a reference chalk mark is to be made with the chalking string being held in close proximity to such surface as it extends out the tip of the toe plate, and second means to hold said retainer in a fixed position with the second of said opposed surfaces adjacent to a surface of said work piece on which a reference chalk mark is to be made with the chalking string being held in close proximity to such surface as it extends out the tip of the toe plate.

10. A chalking line retainer as set forth in claim 9 wherein said first means includes a plate integral with said main body member and extending in a plane substantially perpendicular to the opposed surfaces of the toe plate.

11. A chalking line retainer as set forth in claim 9 wherein said tubular member has a longitudinal axis and said second means includes a center shaft contained within the tubular member and slideable along the longitudinal axis of said tubular member, the center shaft having a pointed end and said tubular member and said center shaft being constructed and arranged so that the pointed end can be driven for a limited distance into a work piece whose surface is to be marked.

12. A chalking line retainer as set forth in claim 10 wherein said tubular member has a longitudinal axis and said second means includes a center shaft contained within the tubular member and slideable along the longitudinal axis of said tubular member, the center shaft having a pointed end and said tubular member and said center shaft being constructed and arranged so that the pointed end can be driven for a limited distance into a work piece whose surface is to be marked.

* * * * *